US005431731A

United States Patent [19]

Salo et al.

[11] Patent Number: 5,431,731

[45] Date of Patent: Jul. 11, 1995

[54] APPLICATOR BEAM IN A SIZE PRESS

[75] Inventors: Markku Salo, Muurame; Ari Rousu, Jyväskylä; Paavo Ruuska, Jyväskylä, all of Finland

[73] Assignee: Valmet Paper Machinery, Inc., Helsinki, Finland

[21] Appl. No.: 45,633

[22] Filed: Apr. 9, 1993

[30] Foreign Application Priority Data

Apr. 10, 1992 [FI] Finland ..... 921630

[51] Int. Cl.[6] ..... B05C 1/00

[52] U.S. Cl. ..... 118/225; 118/255; 118/257

[58] Field of Search ..... 118/63, 602, 612, 258, 118/694, 244, 255–257, 123, 108, 263, 407–410, 416, 225

[56] References Cited

U.S. PATENT DOCUMENTS

| | | | |
|---|---|---|---|
| 3,722,465 | 3/1973 | Krautzberger | 118/123 |
| 4,867,055 | 9/1989 | Hutter et al. | 100/173 |
| 5,048,453 | 9/1991 | Eriksson | 118/255 |
| 5,202,164 | 4/1993 | Takahashi et al. | 118/410 |

FOREIGN PATENT DOCUMENTS

| | | |
|---|---|---|
| 882708 | 12/1988 | Finland . |
| 882708 | 12/1988 | Finland . |
| 894643 | 5/1990 | Finland . |
| 905042 | 10/1990 | Finland . |

*Primary Examiner*—James C. Housel
*Assistant Examiner*—Rachel Freed
*Attorney, Agent, or Firm*—Steinberg, Raskin & Davidson

[57] ABSTRACT

An applicator beam in a size press comprising a nip formed by a pair of press rolls between which a paper or board web is passed. The press rolls are provided with coating devices for spreading films of coating agent onto the faces of the rolls. The coating devices are mounted on applicator beams placed in the transverse direction of the machine. The applicator beams are linked pivotally on the frame of the size press or on the loading arms of a displaceable roll by a pivot shaft arranged transverse to the machine direction. The applicator beams are also provided with pivot cylinders by which the applicator beams can be pivoted between a closed position, i.e. the operating position, and an opened position, i.e. the service position. In accordance with the invention, in its cross section taken in a vertical plane in the longitudinal direction of the machine, the applicator beam is shaped so that at least the curved outer face of the applicator beam that is facing away from the corresponding press roll is curved. Moreover, the pivot shaft of the applicator beam is arranged so that when the applicator beam is pivoted around its pivot shaft, the distance from the curved outer face of the applicator beam to the other constructions of the machine placed close to the applicator beam, such as the tending bridge, remains substantially unchanged.

13 Claims, 3 Drawing Sheets

PRIOR ART
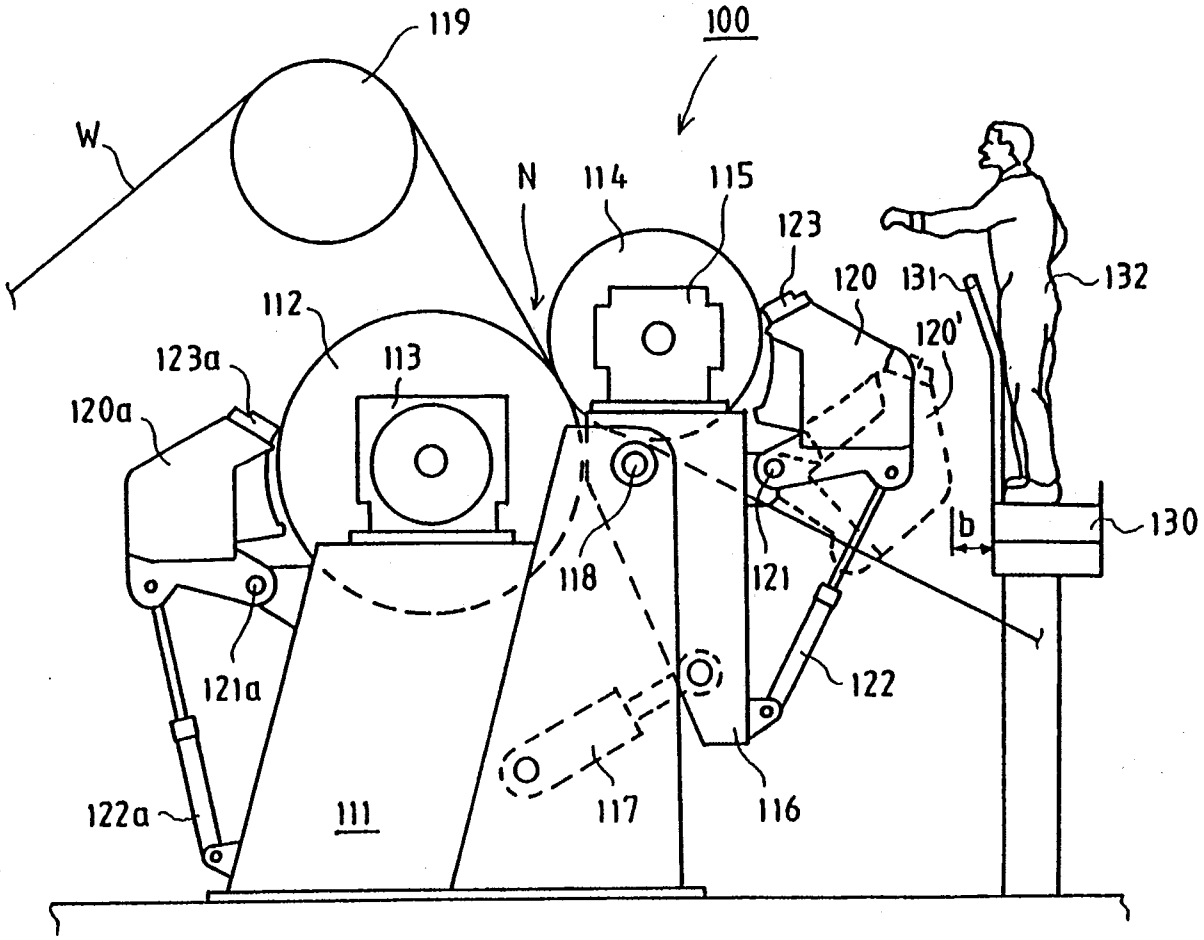
FIG. A1

APPLICATOR BEAM IN A SIZE PRESS

BACKGROUND OF THE INVENTION

The present invention relates to an applicator beam used in a size press which comprises a nip formed by a pair of press rolls. A paper web or board is passed through the nip. A first press roll in the size press is mounted by means of bearings permanently on the frame of the size press. The second press roll is mounted on the frame of the size press by means of its bearings in a manner such that it is displaceable by means of loading arms or equivalent.

The press rolls in the size press are provided with coating devices for spreading films of a coating agent onto the faces of the rolls. The coating devices are mounted on applicator beams which are placed in the transverse direction of the machine, i.e. the size press. The applicator beams are linked pivotally on the frame of the size press or on the loading arms of the displaceable roll by means of a pivot shaft arranged transverse to the machine direction. Further, the applicator beams are provided with pivot cylinders, by whose means the applicator beams can be pivoted between a closed position, i.e. the operating position, and an open position, i.e. the service position.

The construction of a prior art size press is illustrated in FIG. A1. In FIG. A1, the size press is denoted generally with reference numeral 100. Press rolls 112, 114 in the size press 100 form a nip N with each other through which a paper or board web W is passed to be coated with a coating agent such as size. The web W is guided into the nip N over a guide roll 119. A bearing 113 of the first press roll 112 is permanently mounted, or fixed, on a frame 111 of the size press. A bearing 115 of the second press roll 114 is mounted on a loading arm 116. The loading arm 116 is arranged to pivot by means of an articulated joint 118 arranged on the frame 111 of the size press. Loading cylinders 117 are arranged between the frame 111 and the loading arm 116. The loading cylinders 117 function so that the nip N can be opened and closed and also so that the loading pressure between the rolls 112, 114, i.e. the nip pressure, can be adjusted to a desired level.

Each of the press rolls 112, 114 in the size press 100 is provided with an accompanying coating device 123, **123*a*, respectively. The coating devices 123, 123*a* apply a film of a coating agent onto the face of the respective roll 112, 114. The film is transferred onto the web W in the roll nip N. The coating devices 123, 123*a* are separately mounted on an applicator beam 120, 120*a*, respectively, arranged transverse to the machine direction. In the prior art device shown in FIG. A1, the applicator beam 120*a* of the first press roll 112 is mounted pivotally by means of articulated joint 121*a* on the frame 111 of the size press. Pivot cylinders 122*a* are arranged between the applicator beam 120*a* and the frame 111 of the size press. The pivot cylinders 122*a* function to open and close the applicator beam 120*a* in relation to the roll 112**.

In a corresponding manner, the coating device 123 of the second press roll 114 is mounted on an applicator beam 120 arranged transverse to the machine direction. Applicator beam is mounted on the loading arm 116 pivotally by means of the articulated joint 121. Pivot cylinders 122 are arranged between the applicator beam 120 and the loading arm 116. By means of the pivot cylinders 122, the applicator beam 120 can be opened and closed in relation to the second press roll 114.

In the prior art size press 100 described above, a significant drawback is that the large amount of space required by the applicator beam 120 during pivoting of the beam between the operating position and the service position, i.e. the opened position. In FIG. A1, the dashed lines illustrate the service position of the applicator beam of the second press roll 114, as denoted with reference numeral 120'. For servicing the applicator beam 120, a tending bridge 130 is provided on the machine. A service operator 132 standing on the bridge 132 can carry out the necessary operations on the applicator beam 120. As shown in FIG. A1, when the applicator beam 120 is in the operating position, there is a considerably large distance between the tending bridge 130 and the applicator beam 120. For this reason, the tending bridge 130 is provided with a handrail 131 so that the service operator 132 could not even accidentally fall into the space between the tending bridge 130 and the applicator beam 120.

It is necessary to allow the space between the applicator beam 120 and the tending bridge 130 to remain quite large, because when the applicator beam 120 is pivoted to the service position 120' around the articulated joint 121, the applicator beam 120 is shifted much closer to the tending bridge 130. During the pivoting operation, the applicator beam 120 and the tending bridge 130 form a "closing nip". Therefore, on account of the desired level of working safety with regard to the applicator beam 120 during the pivoting operation and also in the service position, and with regard to the tending bridge 130, a safety clearance b must be allowed, which is at the minimum in the range of about 120 mm. By providing the safety clearance b, it is possible to avoid the risk of squeezing (of the operator) when the applicator beam 120 is being opened. Therefore, it is necessary to dimension the distance between the applicator beam 120 and the tending bridge 130 excessively large in view of the user, i.e. the service operator 132. As a result, access to the actuating members of the applicator beam 120 from the tending bridge 130 is not easy and in fact is quite cumbersome.

OBJECTS AND SUMMARY OF THE INVENTION

Accordingly, it is an object of the present invention to provide a solution by whose means the drawbacks described above and related to the prior art devices are avoided.

It is another object of the present invention to provide a new and improved structure of an applicator beam in which the distance between the applicator beam and a tending bride for maintenance of the beam is shorter than in prior art device. In this regard, with a short distance between the tending bridge and the applicator beam, a handrail does not have to be placed on the tending bridge.

In view of achieving this object and others, the applicator beam in accordance with the invention is shaped so that at least a wall of the applicator beam, facing away from the corresponding press roll against which the applicator beam is arranged, is curved. The wall of the applicator beam is curved when viewed in a cross section taken in a vertical plane in the longitudinal direction of the machine. A pivot shaft of the applicator beam is arranged so that when the applicator beam is pivoted around its pivot shaft, the distance from the curved outer face of the applicator beam to the other constructions of the machine placed close to the applicator beam, such as the tending bridge, remain substantially unchanged.

A number of remarkable advantages are obtained by means of the invention over the prior art devices, such as that described above with reference to FIG. A1, in particular when considering the continued maintenance of the applicator beam. First, the outer face of the applicator beam has been shaped, and the pivot point of the applicator beam has been selected, so that, when the beam is pivoted between the operating position and the service position, the distance between the applicator beam and the structures outside the machine, such as the tending bridge, is substantially not changed.

Preferably, the cross-sectional shape of the applicator beam is shaped as an arc of a circle, and the pivot shaft is fitted substantially in the area of the center point of the arc of the circle. In this case, when the applicator beam is pivoted, for example between the tending bridge and the applicator beam, a "closing nip" is not formed, in contrast to the prior art devices. Therefore, the tending bridge can be placed considerably closer to the applicator beam than in the prior art devices. As a result, the servicing possibilities of the applicator beam are substantially improved.

In the device in accordance with the invention, the space between the applicator beam and the tending bridge can be quite small so that the tending bridge does not have to be provided with handrails, This also facilitates the maintenance of the applicator beam.

A further advantage of the solution in accordance with the invention is that the center of gravity of the applicator beam is placed very close to the pivot shaft of the beam. In this manner, the weight of the applicator beam has no substantial effect on the size of the pivot cylinder.

Additional advantages and characteristic features of the invention come out from the following detailed description of the invention.

BRIEF DESCRIPTION OF THE DRAWINGS

The following drawings are illustrative of embodiments of the invention and are not meant to limit the scope of the invention as encompassed by the claims.

FIG. A1 is a side view of a prior art size press.

DETAILED DESCRIPTION OF THE INVENTION

Figure 1:
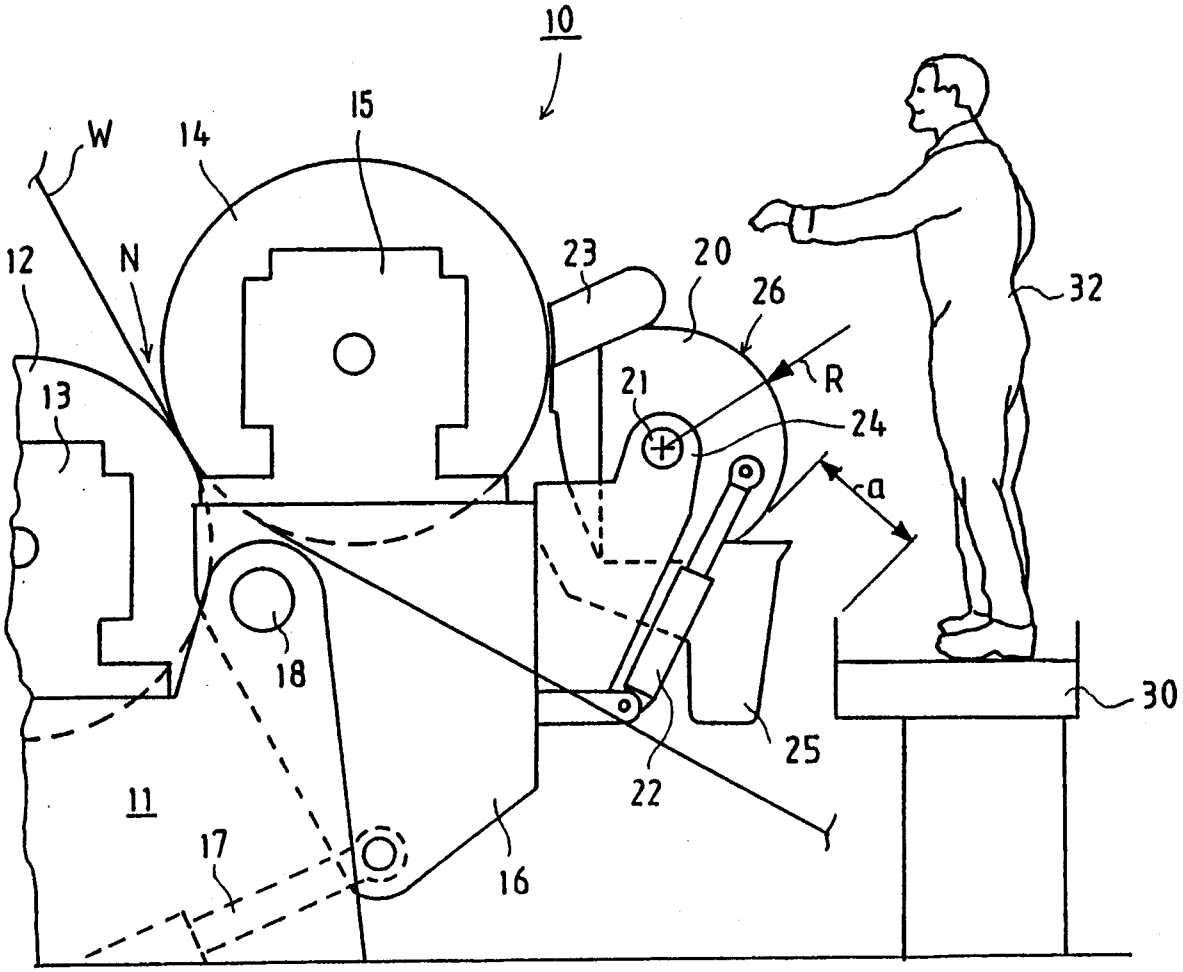
FIG. 1 is a fully schematic partial side view of a size press in which an applicator beam in accordance with the invention has been arranged.

In FIG. 1, the size press is denoted generally with reference numeral 10. Press rolls 12, 14 of the size press 10 form a nip N with each other through which a paper or board web W is passed. A bearing 13 of the first press roll 12 is mounted on a frame 11 of the size press in a permanent manner, i.e. fixed. In a corresponding way, a bearing 15 of the second press roll 14 is mounted on a loading arm 16. Loading arm 16 is arranged on the frame 11 of the size press pivotally by means of an articulated joint 18. Loading cylinders 17 are arranged between the frame 11 and the loading arm 16. By means of the loading cylinders 17, the nip N can be opened and closed and the loading pressure between the rolls 12, 13, i.e. the nip pressure, can be adjusted to a desired level.

Each of the press rolls 12, 14 in the size press 10 is provided with a coating device of its own so that the press rolls 13, 14 are coated during the operation of the size press. In FIG. 1, only a coating device 23 of one of the rolls 14 in the size press is shown. However, another coating device is arranged in conjunction with press roll 13. Films of coating agent are applied to the faces of the rolls 12, 14 by means of the coating devices 23. The films are transferred to the web W in the roll nip N. The coating device 23 is mounted on an applicator beam 20 transverse to the machine direction. In the embodiment shown in FIG. 1, holders 24 have been mounted on the loading arm 16. The applicator beam 20 is mounted pivotally on the holders 24 by means of an articulated joint 21. Underneath the applicator beam 20, a collecting trough 25 separate from the applicator beam is arranged for the collecting the coating agent. The trough 25 communicates with the recirculation system of the coating agent used in the size press.

The applicator beam 20 in accordance with the invention is have a curved cross-sectional shape as shown in FIG. 1, preferably the shape of an arc of a circle. In FIG. 1, the curved outer face of the applicator beam 20 is denoted with the reference numeral 26, and the radius of the curve with the reference R. A pivot shaft 21 is arranged in the area of the center point of the arc of a circle, preferably exactly at the center point.

As a result of this arrangement, the distance a between the applicator beam 20 and a tending bridge 30 does not change when the applicator beam 20 is pivoted and thus the distance between the pivot shaft 21 and the curved outer face of the applicator beam 20 does not change. Thus, the tending bridge 30 can be placed very close to the applicator beam 20 because there is no risk of squeezing (the operator) between the applicator beam 20 and the tending bridge 30. As shown in FIG. 1, the handrail of the tending bridge, which is used in connection with conventional solutions, can be omitted, and the service operator 32 has easy access to the actuating members of the applicator beam 20.

Moreover, as a result of the cross-sectional shape of the applicator beam 20 in accordance with the invention, the center of gravity of the applicator beam 20 is placed very close to the pivot shaft 21. In this manner, the weight of the applicator beam 20 does not affect the dimensioning of the pivot cylinders 22. Further, in a solution in accordance with the invention, the construction and installation of the tending bridge 30 can be fixed, e.g., to the frame of the size press, unlike the prior art devices which often require a displaceable tending bridge.

Figure 2:
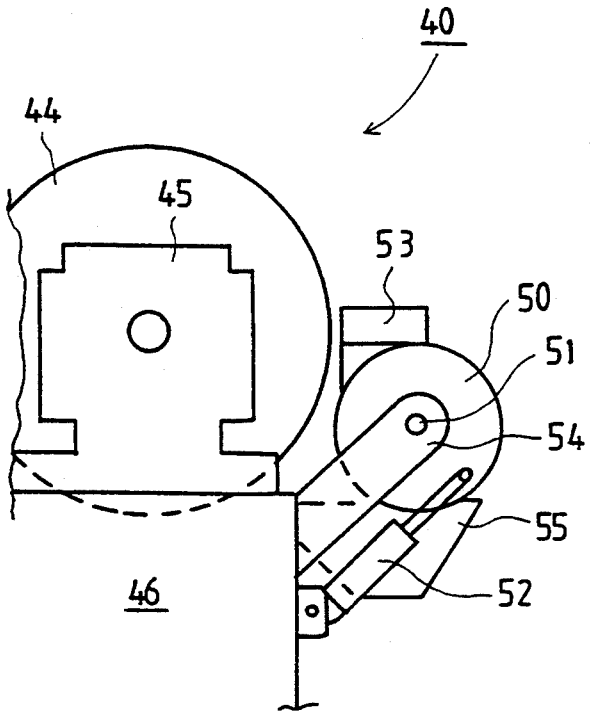
FIG. 2 is a schematic illustration of another embodiment of an applicator beam in accordance with the invention.

FIG. 2 shows an alternative embodiment to the construction of the applicator beam shown in FIG. 1. The illustration in FIG. 2 has been decreased from the illustration of FIG. 1 so that the parts not included in the scope of the invention have been omitted in the illustration in FIG. 2.

In FIG. 2, the size press is denoted generally with the reference numeral 40. A press roll 44, which corresponds to the second press roll 14 in the illustration in FIG. 1, is mounted by means of bearings 45 on a loading arm 46. Holders 54 have been arranged on the loading arm 46. An applicator beam 50 is mounted on the holders 54 by means of a pivot shaft 51. In FIG. 2, the coating device is denoted fully schematically with reference numeral 53, the coating agent collecting trough is denoted with reference numeral 55, and the pivot cylinders of the applicator beam 50 are denoted with reference numeral 52. The embodiment shown in FIG. 2 differs from the construction shown in FIG. 1 in that, in the embodiment of FIG. 2, the applicator beam 50 is formed as of substantially fully circular cross-sectional shape i.e. cylindrical. This provides the additional advantage that the pivot shaft 51, which is arranged, in a manner corresponding to the embodiment of FIG. 1, substantially at the center point of the surface of revolution of the applicator beam 50, is placed as close as possible to the center of gravity of the applicator beam 50. In such a case, the pivot cylinders 52 intended for pivoting of the applicator beam 50 can be reduced in size.

The examples provided above are not meant to be exclusive. Many other variations of the present invention would be obvious to those skilled in the art, and are contemplated to be within the scope of the appended claims.

We claim:

1. An applicator beam for use in a size press construction, said size press construction having a longitudinal machine direction and including a pair of press rolls mounted on a press frame forming a nip through which a web is passed, and coating means mounted on said applicator beam for spreading coating agent onto surfaces of said press rolls, said applicator beam comprising:

an elongate beam body extending transversely to said machine direction in operative relationship to a corresponding one of said press rolls, said beam body having a wall portion having an outer surface which faces away from said corresponding press roll, said outer surface having a curved configuration in a cross section in a vertical plane in said longitudinal machine direction; and pivot means for mounting said applicator beam body for pivotal movement with respect to a transverse pivot axis between a closed operating position and an open service position;

said curved outer surface extending along a substantial portion of said wall portion such that the distance in said machine direction between said curved outer surface and said pivot axis is substantially constant as said applicator beam pivots between said closed and open positions.

2. The applicator beam of claim 1, wherein one of said press rolls is fixedly mounted by means of bearings on a frame of the size press construction, and the other of said press rolls being displacebly mounted on the frame of the size press by means of additional bearings, and wherein said size press construction further includes loading means for displacing said other of said press rolls.

3. The applicator beam of claim 1, wherein said pivot means are mounted on one of the frame of the size press construction and loading means.

4. The applicator beam of claim 1, wherein said pivot means is arranged such that said pivot axis is situated in a region of the center of curvature of the curved outer surface of said applicator beam.

5. The applicator beam of claim 3, wherein said pivot means is arranged such that said pivot axis is situated in a region of the center of curvature of the curved outer surface of said applicator beam.

6. The applicator beam of claim 1, wherein the curved outer surface of said applicator beam is circular.

7. The applicator beam of claim 1, wherein said pivot means is arranged such that said pivot axis is situated in a region of the center of gravity of said applicator beam.

8. The applicator beam of claim 2, wherein said loading means comprise loading arms arranged on the frame of the size press.

9. The applicator beam of claim 1, wherein said wall portion has a periphery, the entire periphery of said wall portion having a circular cross-section.

10. The applicator beam of claim 1, wherein said wall portion has a periphery, a substantial portion of the periphery of said wall portion having a circular cross-section.

11. The applicator beam of claim 1, wherein said wall portion is cylindrical.

12. The applicator beam of claim 1, wherein said wall portion comprises a substantially cylindrical segment to thereby define said curved outer surface.

13. The applicator beam of claim 1, wherein said machine direction is a horizontal plane in which said size press construction is situated.

* * * * *